United States Patent [19]

T'Jampens et al.

[11] Patent Number: 4,479,071

[45] Date of Patent: Oct. 23, 1984

[54] HIGH-PRESSURE DISCHARGE LAMP HAVING SHIELDING MEANS COMPRISED OF BORON NITRIDE

[75] Inventors: Germain R. T'Jampens; Abraham Coomans, both of Eindhoven, Netherlands

[73] Assignee: U.S. Philips Corporation, New York, N.Y.

[21] Appl. No.: 355,441

[22] Filed: Mar. 8, 1982

[30] Foreign Application Priority Data

Apr. 8, 1981 [NL] Netherlands ..... 8101723

[51] Int. Cl.[3] ..... H01J 61/04; H01J 61/52

[52] U.S. Cl. ..... 313/25; 313/42; 313/626

[58] Field of Search ..... 313/25, 613, 626, 630, 313/638, 639, 485, 42, 43, 44

[56] References Cited

U.S. PATENT DOCUMENTS 3,662,203 5/1972 Kuhl et al. ..... 313/112 X

FOREIGN PATENT DOCUMENTS 476250 8/1951 Canada ..... 313/25
15551 2/1981 Japan ..... 313/626
863468 3/1961 United Kingdom ..... 313/626

*Primary Examiner*—David K. Moore
*Assistant Examiner*—K. Wieder
*Attorney, Agent, or Firm*—Robert S. Smith

[57] ABSTRACT

The invention relates to a high-pressure metal halide lamp in which the filling of the discharge vessel also comprises an alkali metal. The discharge vessel is surrounded by an outer envelope. One electrode of the discharge vessel is connected to a current supply conductor extending between the discharge vessel and the outer envelope. A plate-shaped element is mounted between the discharge vessel and the outer envelope in such manner that, viewed from the discharge vessel, the current supply conductor is present substantially entirely behind the plate-shaped element.

According to the invention, the plate-shaped element comprises boron nitride.

Increase of the arc voltage of the lamp and increase of the color temperature of the radiation emitted by the lamp is prevented in this manner.

9 Claims, 1 Drawing Figure

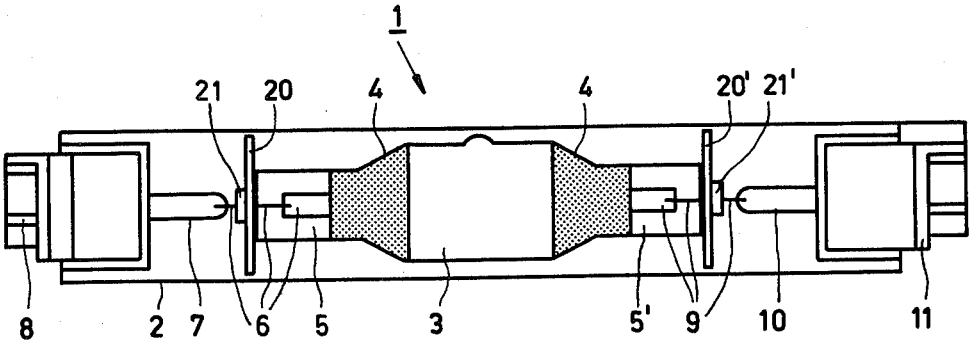
1
21
20
4
4
20'
21'
8
2
7
6
5
3
5'
9
10
11

HIGH-PRESSURE DISCHARGE LAMP HAVING SHIELDING MEANS COMPRISED OF BORON NITRIDE

The invention relates to a high-pressure metal halide lamp having a discharge vessel surrounded by an outer envelope, which vessel has an ionizable filling comprising at least an alkali metal and a halogen and is provided with two electrodes between which in the operating condition of the lamp the discharge takes place, at least one electrode being connected to a current supply conductor extending between the discharge vessel and the outer envelope, a plate-shaped element being present in said lamp between the discharge vessel and the outer envelope in such manner that, viewed from the discharge vessel, the current supply conductor is present substantially entirely behind the plate-shaped element.

Such a lamp is known from U.S. Pat. No. 3,662,203. In this known lamp the plate-shaped element is made of metal. It has been found that during the lifetime of this known lamp the color temperature of the emitted radiation increases considerably, while also the arc voltage of the lamp increases. In the end, the arc voltage increase gives rise to extinction of the lamp. It is the object of the invention to provide a means to prevent or at least reduce the increase of the color temperature and of the arc voltage.

According to the invention, a lamp of the kind mentioned in the opening paragraph is characterized in that the plate-shaped element comprises boron nitride.

It has been found that in lamps according to the invention the color temperature of the emitted radiation remains substantially constant during the lifetime and the arc voltage shows only a small increase. An advantage of the use of boron nitride is the good heat resistance. This permits of placing the plate-shaped element as close as possible to the discharge vessel.

The invention is based on the recognition of the fact that increase of the color temperature and increase of the arc voltage in this type of lamp may be a result of withdrawing from the discharge alkali metal ions of the filling of the discharge vessel. This takes place under the influence of a negative space charge in the space between the discharge vessel and the outer envelope. The negative space charge is caused by electrons which, under the influence of shortwave radiation emitted by the discharge, are liberated from metal parts present in the space between the discharge vessel and the outer envelope. This negative space charge has for its result that positive alkali metal ions of the filling of the discharge vessel diffuse through the wall of the discharge vessel and are withdrawn from the discharge. Besides an increase of color, temperature and arc voltage, this also has for its result that blackening of the outer envelope occurs.

It has been found that boron nitride is impervious to shortwave radiation over a large spectral range, and the plate-shaped element according to the invention hence ensures that no shortwave radiation reaches the supply conductor. It is not necessary for the plate-shaped element to consist solely of boron nitride.

In an embodiment of a lamp in accordance with the invention the plate-shaped element has a thickness of at most 2 mm and it is composed of for at least 30% by weight of boron nitride and for at most 70% by weight of silicon oxide. In such a plate-shaped element a screening is obtained which is sufficiently impervious to shortwave radiation between on the one hand the current supply conductor and on the other hand for the radiation emitted by the discharge, also in the case of minimum thickness of the plate-shaped element. This minimum thickness of the element is only determined by the requirements of mechanical workability and handlability. In addition, such a plate-shaped element has the advantage of a very small water absorption capacity, and hence the element can withstand rapid temperature variations as they occur during the manufacture of the lamp.

In an advantageous embodiment of a lamp in accordance with the invention the plate-shaped element comprises for at least 90% by weight of boron nitride and for at most 10% by weight of calcium borate. An advantage is that an element thus composed combines a good mechanical workability with the property of being capable of absorbing only little water.

The plate-shaped elements can be obtained, for example, by hot-pressing boron nitride or a mixture of boron nitride with an addition. As an addition is useful, for example, silicon dioxide, calcium oxide, aluminium oxide, magnesium silicate, or aluminium phosphate.

The filling of the discharge vessel in a lamp in accordance with the invention preferably comprises sodium halide and/or lithium halide and furthermore mercury as a buffer gas. The addition of sodium halide and/or lithium halide to the filling of the discharge vessel has for its advantage that the light emitted by the lamp has a lower color temperature as compared with a corresponding lamp without the said addition. The addition of sodium halide also leads to a higher specific luminous efficacy (1 m/W). In the case of the addition of lithium a larger part of the emitted radiation is emitted in the red part of the spectrum.

An embodiment of a lamp according to the invention will be explained in greater detail with reference to a drawing.

Reference numeral 1 in the drawing indicates a high-pressure metal halide lamp having a discharge vessel 3 of quartz and an outer envelope 2 of quartz glass comprising approximately 96% by weight of $SiO_2$. The discharge vessel 3 comprises pinches 5, 5'. Pinch 5 comprises a leadthrough element 6 of molybdenum by means of which a first electrode (not shown) of tungsten of the lamp is connected to a current supply conductor 7 of molybdenum. The supply conductor 7 extends between the discharge vessel and the outer envelope 2 and is connected to a connection contact 8 of the lamp. Correspondingly, a leadthrough element 9 of molybdenum is connected to a connection contact 11 via a current supply conductor 10 also of molybdenum. A second electrode (not shown) of tungsten is connected to the leadthrough element 9. In the operating condition of the lamp the discharge takes place between the two electrodes not shown. At the area of the electrodes not shown, the discharge vessel 3 has an external ZrO-layer 4.

Two plate-shaped elements 20 and 20' are mounted between the discharge vessel and the outer envelope in such manner that, viewed from the discharge vessel 3, the current supply conductors 7 and 10, respectively, are present substantially entirely behind the plate-shaped elements 20 and 20', respectively. The plate-shaped elements 20 and 20' the thickness of which is approximately 1 mm, comprise 95% by weight of boron nitride and 1% by weight of calcium. Getters 21, 21' are also placed between the discharge vessel and the outer envelope. The getters 21, 21' are preferably placed on the side of the plate-shaped elements 20 and 20' remote from the discharge, so that the getters 21, 21' are also screened from shortwave radiation emitted by the discharge. The plate-shaped elements 20, 20' are mounted by sliding over the beam-like parts of the leadthrough elements 6 and 9. The elements are held in place by means of the getters 21 and 21' which in turn are connected to the beam-like parts of the leadthrough elements 6, 9 by means of a solder or a weld.

The lamp shown has a power of 250 W and is suitable for being supplied with an alternating voltage of 220 V, 50 Hz. The discharge vessel has a filling consisting of 6.5 mg of $TmJ_3$, 3.6 mg of NaJ, 0.25 mg of T1J, 12.5 mg of Hg and $5\times10^3$ Pa of Ar with 0.002 vol.% of krypton 85. The space between the discharge vessel and the outer envelope is evacuated. The arc voltage in Volts, the specific luminous flux in 1 m/W and the color temperature in Kelvin of the lamp during the lifetime are:

after 0 hours in operation 95 V, 93 1 m/W and 4300 K
after 100 hours in operation 100 V, 92 1 m/W and 4300 K
after 1,000 hours in operation 103 V, 90 1 m/W and 4300 K
after 2,000 hours in operation 104 V, 84 1 m/W and 4400 K
after 3,000 hours in operation 106 V, 80 1 m/W and 4550 K
after 4,000 hours in operation 109 V, 76 1 m/W and 4600 K In the case of a corresponding lamp in which, however, the plate-shaped element is made of metal, the measurement of the arc voltage, the specific luminous flux and the colour temperature has yielded the following results:

after 0 hours in operation 95 V, 91 1 m/W and 4200 K
after 100 hours in operation 100 V, 91 1 m/W and 4250 K
after 500 hours in operation 112 V, 79 1 m/W and 4650 K
after 1,000 hours in operation 111 V, 55 1 m/W and 5100 K.

After 100 hours in operation, the outer envelope of this corresponding lamp began to blacken.

What is claimed is:

1. A high-pressure metal halide lamp having a discharge vessel surrounded by an outer envelope, said discharge vessel has an ionizable filling comprising at least an alkali metal and a halogen and is provided with two electrodes between which in the operating condition of said lamp the discharge takes place, at least one electrode being connected to a current supply conductor extending between said discharge vessel and said outer envelope, a plate-shaped element being present in said lamp between said discharge vessel and said outer envelope in such manner that, when viewed from said discharge vessel, said current supply conductor is present substantially entirely behind said plate-shaped element, characterized in that said plate-shaped element comprises boron nitride.

2. A lamp as claimed in claim 1, characterized in that said plate-shaped element has a thickness of at most 2 mm and that said plate-shaped element comprises at least 30% by weight of boron nitride and at most 70% by weight of silicon oxide.

3. A lamp as claimed in claim 1 or 2, characterized in that said plate-shaped element comprises for at least 90% by weight of boron nitride and at most 10% by weight of calcium borate.

4. A lamp as claimed in claim 1, characterized in that said filling of the discharge vessel comprises sodium halide and mercury as a buffer gas.

5. A lamp as claimed in claim 2 characterized in that said filling of said discharge vessel comprises sodium halide and mercury as a buffer gas.

6. A lamp as claimed in claim 3 characterized in that said filling of said discharge vessel comprises sodium halide and mercury as a buffer gas.

7. A lamp as claimed in claim 1 characterized in that said filling of said discharge vessel comprises lithium halide and mercury as a buffer gas.

8. A lamp as claimed in claim 2 characterized in that said filling of said discharge vessel comprises lithium halide and mercury as a buffer gas.

9. A lamp as claimed in claim 3 characterized in that said filling of said discharge vessel comprises lithium halide and mercury as a buffer gas.

* * * * *